US007913667B2

(12) United States Patent
Tomoda et al.

(10) Patent No.: US 7,913,667 B2
(45) Date of Patent: Mar. 29, 2011

(54) FUEL SUPPLY APPARATUS FOR VEHICLE

(75) Inventors: Terutoshi Tomoda, Mishima (JP); Tomihisa Tsuchiya, Toyota (JP); Mitsuto Sakai, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 1130 days.

(21) Appl. No.: 11/335,622

(22) Filed: Jan. 20, 2006

(65) Prior Publication Data

US 2006/0196475 A1 Sep. 7, 2006

(30) Foreign Application Priority Data

Mar. 2, 2005 (JP) ..... 2005-057438

(51) Int. Cl.
*F02M 69/46* (2006.01)

(52) U.S. Cl. ..... 123/456; 123/457

(58) Field of Classification Search ..... 123/430, 123/431, 295–299, 497, 516, 446, 510, 456, 123/467; 239/585.5, 533.1–533.9, 453, 87, 239/90; 92/52; 60/285
See application file for complete search history.

(56) References Cited

U.S. PATENT DOCUMENTS

| | | | | |
|---|---|---|---|---|
| 5,924,405 | A * | 7/1999 | Hashimoto | 123/431 |
| 6,095,118 | A | 8/2000 | Klinger et al. | |
| 6,314,940 | B1 | 11/2001 | Frey et al. | |
| 6,986,646 | B2 * | 1/2006 | Bettenhausen et al. | 417/53 |
| 7,013,872 | B2 * | 3/2006 | Yamazaki et al. | 123/431 |
| 7,219,655 | B2 * | 5/2007 | Shinogle | 123/456 |
| 2002/0092505 | A1 * | 7/2002 | Rembold et al. | 123/464 |
| 2003/0041838 | A1 | 3/2003 | Tsuchiya | |
| 2004/0168673 | A1 * | 9/2004 | Shinogle | 123/456 |
| 2005/0072405 | A1 | 4/2005 | Kojima et al. | |
| 2005/0241617 | A1 | 11/2005 | Kojima | |

FOREIGN PATENT DOCUMENTS

| | | |
|---|---|---|
| EP | 1 039 112 A2 | 9/2000 |
| FR | 2 669 377 | 5/1992 |
| JP | A-56-146423 | 11/1981 |
| JP | A-01-104959 | 4/1989 |
| JP | U-64-056559 | 4/1989 |
| JP | A 04-252855 | 9/1992 |
| JP | A-05-104961 | 4/1993 |
| JP | A-07-103048 | 4/1995 |

(Continued)

OTHER PUBLICATIONS

U.S. Appl. No. 11/272,973, filed Jan. 25, 2005, Furusawa et al.

*Primary Examiner* — Michael Cuff
*Assistant Examiner* — Keith Coleman
(74) *Attorney, Agent, or Firm* — Oliff & Berridge, PLC

(57) ABSTRACT

Fuel pipes guide fuel from a fuel tank provided in a rear area of the vehicle to a low-pressure fuel supply system and a high-pressure fuel supply system, respectively, for injecting the fuel to an engine provided in a front area of the vehicle. A branch point between the fuel pipes is arranged in the vicinity of the fuel tank to secure a long pipe length between the low-pressure fuel supply system and the high-pressure fuel supply system. This can suppress variation in fuel pressure at the low-pressure fuel supply system attributable to the fuel that is discharged from the high-pressure fuel pump within the high-pressure fuel supply system back to the fuel pipe.

6 Claims, 4 Drawing Sheets

FOREIGN PATENT DOCUMENTS

| | | |
|---|---|---|
| JP | A-07-253020 | 10/1995 |
| JP | A-07-257199 | 10/1995 |
| JP | A 08-082250 | 3/1996 |
| JP | A-09-025860 | 1/1997 |
| JP | U-2532528 | 1/1997 |
| JP | A 11-062772 | 3/1999 |
| JP | A 11-351043 | 12/1999 |
| JP | A-2000-257524 | 9/2000 |
| JP | A-2000-274329 | 10/2000 |
| JP | A 2002-235571 | 8/2002 |
| JP | A-2003-74441 | 3/2003 |
| JP | A-2004-060474 | 2/2004 |
| JP | A 2005-106027 | 4/2005 |
| JP | A 2005-315174 | 11/2005 |
| RU | C2 2 177 077 | 12/2001 |
| RU | C2 2 194 187 | 12/2002 |

* cited by examiner

FUEL SUPPLY APPARATUS FOR VEHICLE

This nonprovisional application is based on Japanese Patent Application No. 2005-057438 filed with the Japan Patent Office on Mar. 2, 2005, the entire contents of which are hereby incorporated by reference.

BACKGROUND OF THE INVENTION

1. Field of the Invention

The present invention relates to a fuel supply apparatus for a vehicle, and more particularly to a fuel supply apparatus for a vehicle provided with a plurality of fuel supply systems to an internal combustion engine.

2. Description of the Background Art

As a configuration of an internal combustion engine, one having both an intake manifold injector for injecting fuel into an intake port and an in-cylinder injector for injecting fuel into a cylinder is known. In this internal combustion engine, fuel injection control is carried out by combining intake manifold injection using the intake manifold injector and in-cylinder direct injection using the in-cylinder injector in accordance with an operation state.

In such an internal combustion engine, the pressure of the fuel injected from the in-cylinder injector, which sprays the fuel directly into the cylinder, needs to be set to a high pressure. Meanwhile, the pressure of the fuel injected from the intake manifold injector is lower than the pressure required for the in-cylinder injector. As such, in a fuel supply apparatus for the internal combustion engine, a plurality of fuel supply systems different in pressure of the supply fuel are arranged.

In particular, in the configuration where a high-pressure fuel pump provided in a fuel supply system supplying fuel to the in-cylinder injector (i.e., high-pressure fuel supply system) discharges excess fuel back to the fuel intake side at every discharge stroke, it has been pointed out that pulsation in fuel pressure occurs in a fuel supply system supplying fuel to the intake manifold injector (i.e., low-pressure fuel supply system) (e.g., Japanese Patent Laying-Open No. 11-351043; hereinafter, referred to as "Patent Document 1").

Patent Document 1 proposes a configuration for suppressing the influence of such pulsation in fuel pressure on the intake manifold injector (auxiliary fuel injection valve), wherein a fuel filter is arranged at a fuel pipe, between a fuel return port of a high-pressure regulator adjusting the fuel injection pressure of the in-cylinder injector (main fuel injection valve) and a connection port to a fuel supply pipe to the intake manifold injector (auxiliary fuel injection valve). In the fuel injection control apparatus disclosed in Patent Document 1, provision of the fuel filter can prevent the pulsation in fuel pressure, generated due to the returned excess fuel, from adversely affecting the fuel pressure of the intake manifold injector (auxiliary fuel injection valve).

A configuration for a fuel supply apparatus is also proposed (e.g., Japanese Patent Laying-Open No. 08-082250; hereinafter, referred to as "Patent Document 2"), wherein a fuel supply cutoff valve is arranged at a fuel pipe so as to prevent leakage of fuel when an engine is damaged due to collision of the vehicle or the like. In the fuel leakage preventing apparatus disclosed in Patent Document 2, the fuel supply cutoff valve is closed when an acceleration sensor detects a change in acceleration exceeding a prescribed value.

SUMMARY OF THE INVENTION

When a pressure attenuation mechanism such as the fuel filter is provided at the high-pressure fuel supply system as in the configuration disclosed in Patent Document 1, however, vapor lock may occur in the high-pressure fuel pump, causing variation in fuel pressure at the in-cylinder injector (main fuel injection valve). Further, neither Patent Document 1 nor Patent Document 2 specifically discloses how the fuel pipes are arranged from the fuel tank to the high-pressure fuel supply system and to the low-pressure fuel supply system in a vehicle.

The present invention has been made to solve the above-described problems, and an object of the present invention is to provide a fuel pipe configuration in a fuel supply apparatus for a vehicle provided with a plurality of fuel supply systems to an internal combustion engine, that can suppress pulsation in fuel pressure in the fuel supply systems.

A fuel supply apparatus for a vehicle according to the present invention includes a fuel tank, a first fuel supply system, a second fuel supply system, a first fuel pipe, and a second fuel pipe. The fuel tank is arranged in a rear area with respect to the center of the vehicle and stores fuel. The first fuel supply system includes a first fuel injection mechanism for injecting fuel into an internal combustion engine that is arranged in a front area with respect to the center of the vehicle. The second fuel supply system includes a second fuel injection mechanism that is different from the first fuel injection mechanism for injecting fuel into the internal combustion engine. The first fuel pipe is provided to guide the fuel from the fuel tank to the first fuel supply system. The second fuel pipe is provided to guide the fuel from the fuel tank to the second fuel supply system. The first and second fuel pipes are branched in the vicinity of the fuel tank.

According to the fuel supply apparatus for a vehicle described above, the branch point between the first and second fuel pipes for guiding the fuel from the fuel tank to the first and second fuel supply systems, respectively, is arranged in the vicinity of the outlet side of the fuel tank. This can secure a sufficiently long fuel pipe length between the first and second fuel supply systems, and thus, it is possible to prevent the factor of variation in fuel pressure in one fuel supply system from adversely affecting the other fuel supply system. Accordingly, a fuel pipe configuration capable of suppressing variation (pulsation) in fuel pressure in the respective fuel supply systems can be implemented.

Preferably, in the fuel supply apparatus for a vehicle according to the present invention, one and the other of the first and second fuel pipes are arranged in a right area and a left area, respectively, with respect to the center of the vehicle.

According to the fuel supply apparatus for a vehicle described above, the first fuel pipe for guiding the fuel to the first fuel supply system and the second fuel pipe for guiding the fuel to the second fuel supply system are arranged in one and the other of the left and right areas with respect to the center of the vehicle. Thus, even in the case where one fuel pipe and/or one fuel supply system is damaged due to collision on a side of the vehicle, for example, the other fuel pipe and the other fuel supply system can continue fuel injection to the internal combustion engine. This allows the driver to move the vehicle to safety at the time of collision on a side of the vehicle.

Still preferably, in the fuel supply apparatus for a vehicle according to the present invention, the first fuel supply system includes a high-pressure fuel pump that pressurizes the fuel guided by the first fuel pipe and discharges the resultant fuel, and controls a pressure of the fuel injected from the first fuel injection mechanism to a prescribed pressure. Further, the second fuel supply system sets a pressure of the fuel injected from the second fuel injection mechanism to a pressure lower than the prescribed pressure.

According to the fuel supply apparatus for a vehicle described above, the pressure of the fuel injected by the first fuel supply system can be maintained at a high level, and thus, the fuel can be injected directly into the cylinder with the first fuel supply system. Meanwhile, the intake manifold injection mechanism (for example, intake manifold injector) can inject the fuel at a pressure lower than the prescribed pressure via the second fuel supply system. Accordingly, in the internal combustion engine provided with both the in-cylinder injection mechanism (e.g., in-cylinder injector) and the intake manifold injection mechanism, a fuel pipe configuration that can suppress variation in fuel pressure in the respective injectors can be implemented.

Still preferably, the fuel supply apparatus for a vehicle according to the present invention further includes a fuel cutoff valve. The fuel cutoff valve is arranged in at least one of the first and second fuel pipes, between a branch point of the first and second fuel pipes and the first or second fuel supply system, in the vicinity of the branch point.

According to the fuel supply apparatus for a vehicle described above, the fuel cutoff valve capable of stopping fuel supply from the fuel tank is provided in at least one of the first and second fuel pipes. The fuel cutoff valve is arranged in the vicinity of the branch point of the first and second fuel pipes, which can minimize fuel leakage upon breakage of the fuel pipe.

In the above-described configuration, particularly, the fuel supply apparatus for a vehicle further includes an acceleration sensor. The acceleration sensor is provided for at least one of the first and second fuel pipes, corresponding to the fuel cutoff valve. The fuel cutoff valve is actuated in accordance with a detected value of the corresponding acceleration sensor to cut off the fuel.

According to the fuel supply apparatus for a vehicle described above, the acceleration sensor can be used to determine the presence/absence of collision on the side of the vehicle on which the corresponding fuel pipe is arranged, and the fuel cutoff valve can be used to automatically cut off the fuel supply upon occurrence of the collision. As a result, it is possible to minimize the fuel leakage upon breakage of the fuel pipe due to the collision.

A fuel supply apparatus for a vehicle according to another aspect of the present invention includes a fuel tank, a first fuel supply system, a second fuel supply system, a first fuel pipe, and a second fuel pipe. The fuel tank is arranged in a rear area with respect to the center of the vehicle and stores fuel. The first fuel supply system includes a first fuel injection mechanism for injecting fuel into an internal combustion engine that is arranged in a front area with respect to the center of the vehicle. The second fuel supply system includes a second fuel injection mechanism that is different from the first fuel injection mechanism for injecting fuel into the internal combustion engine. The first fuel pipe is provided to guide the fuel from the fuel tank to the first fuel supply system. The second fuel pipe is provided to guide the fuel from the fuel tank to the second fuel supply system. The first and second fuel pipes are branched in the rear area of the vehicle.

A fuel supply apparatus for a vehicle according to still another aspect of the present invention includes a fuel tank, a first fuel supply system, a second fuel supply system, a first fuel pipe, and a second fuel pipe. The fuel tank is configured to store fuel. The first fuel supply system includes a first fuel injection mechanism for injecting fuel into an internal combustion engine. The second fuel supply system includes a second fuel injection mechanism that is different from the first fuel injection mechanism for injecting fuel into the internal combustion engine. The first fuel pipe is provided to guide the fuel from the fuel tank to the first fuel supply system. The second fuel pipe is provided to guide the fuel from the fuel tank to the second fuel supply system. A branch point between the first and second fuel pipes is arranged such that a fuel pipe length between the branch point and the fuel tank is shorter than a fuel pipe length between the branch point and each of the first and second fuel supply systems.

As described above, a main advantage of the present invention is that it is readily possible to implement a fuel pipe configuration capable of suppressing pulsation in fuel pressure in each of a plurality of fuel supply systems to an internal combustion engine.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
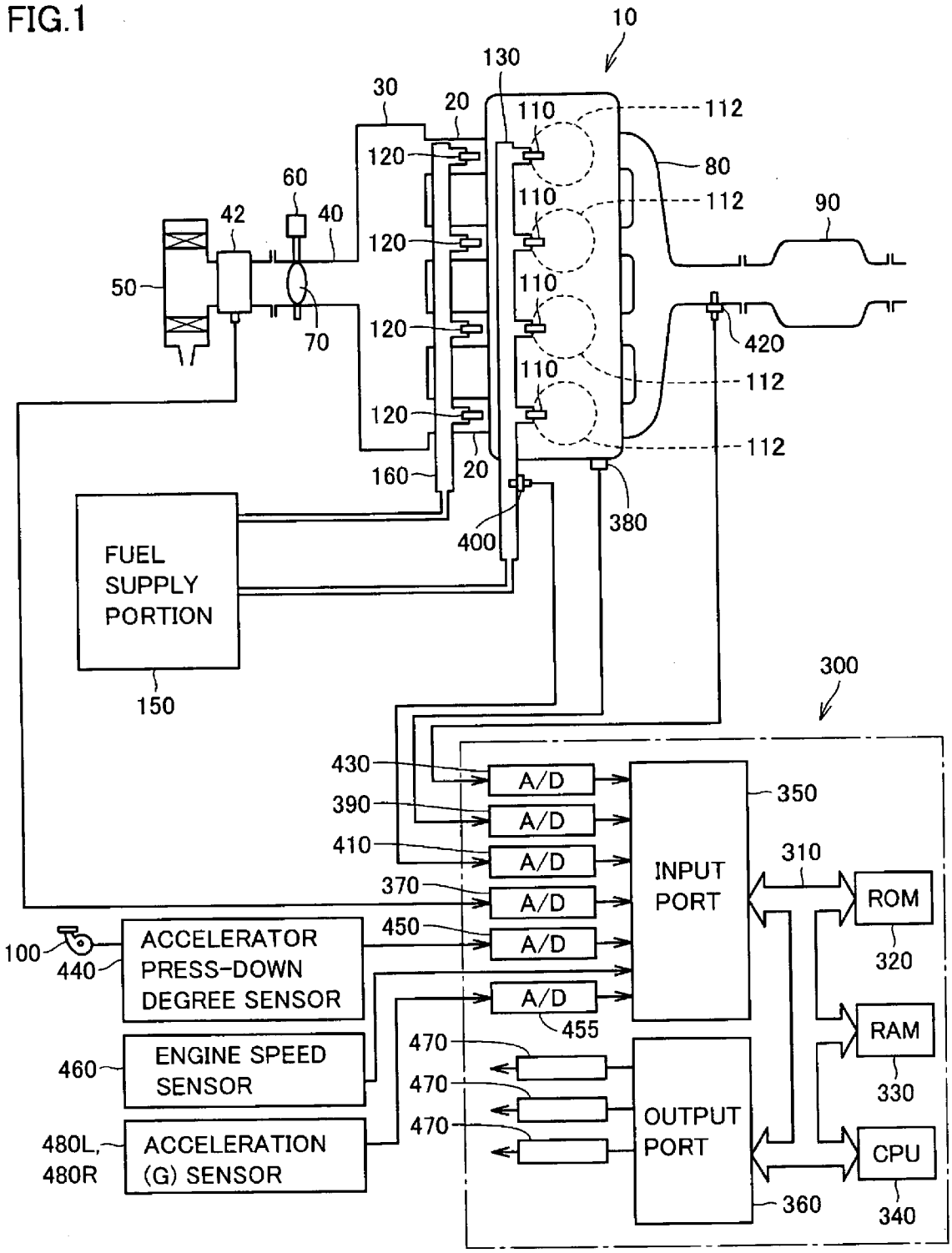
FIG. 1 is a schematic configuration diagram of an engine system incorporating a fuel supply apparatus according to an embodiment of the present invention.

Hereinafter, an embodiment of the present invention will be described in detail with reference to the drawings. In the following, the same or corresponding portions in the drawings have the same reference characters allotted, and detailed description thereof will not be repeated where appropriate.

FIG. 1 schematically shows an engine system incorporating a fuel supply apparatus according to an embodiment of the present invention. Although an in-line 4-cylinder gasoline engine is shown in FIG. 1, application of the present invention is not restricted to the engine shown.

As shown in FIG. 1, the engine (internal combustion engine) 10 includes four cylinders 112, which are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its degree of opening controlled based on an output signal of an engine ECU (Electronic Control Unit) 300, independently from an accelerator pedal 100. Cylinders 112 are connected to a common exhaust manifold 80, which is in turn connected to a three-way catalytic converter 90.

For each cylinder 112, an in-cylinder injector 110 for injecting fuel into the cylinder and an intake manifold injector 120 for injecting fuel into an intake port and/or an intake manifold are provided. Injectors 110, 120 are controlled based on output signals of engine ECU 300.

In-cylinder injectors 110 are connected to a common fuel delivery pipe (hereinafter, also referred to as "high-pressure delivery pipe") 130, and intake manifold injectors 120 are connected to a common fuel delivery pipe (hereinafter, also referred to as "low-pressure delivery pipe") 160. Fuel supply to fuel delivery pipes 130, 160 is carried out by a fuel supply portion 150, which will be described later in detail. Low-pressure delivery pipe 160, fuel supply portion 150, and high-pressure delivery pipe 130 constitute the fuel supply apparatus in the engine system shown in FIG. 1.

Engine ECU 300 is configured with a digital computer, which includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to high-pressure delivery pipe 130, which generates an output voltage proportional to a fuel pressure in high-pressure delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a theoretical air-fuel ratio.

Accelerator pedal 100 is connected to an accelerator press-down degree sensor 440 that generates an output voltage proportional to the degree of press-down of accelerator pedal 100. The output voltage of accelerator press-down degree sensor 440 is input via an A/D converter 450 to input port 350. An engine speed sensor 460 generating an output pulse representing the engine speed is connected to input port 350. Further, acceleration sensors (G sensors) 480L, 480R each measure acceleration at the position where it is located, and transmit an output voltage proportional to the measured acceleration to engine ECU 300. The output voltages of acceleration sensors 480L, 480R are input via an A/D converter 455 to input port 350.

ROM 320 of engine ECU 300 prestores, in the form of a map, values of fuel injection quantity that are set corresponding to operation states based on the engine load factor and the engine speed obtained by the above-described accelerator press-down degree sensor 440 and engine speed sensor 460, respectively, and the correction values based on the engine coolant temperature. Engine ECU 300 generates various control signals for controlling the overall operations of the engine system based on signals from the respective sensors by executing a prescribed program. The control signals are transmitted to the devices and circuits constituting the engine system via output port 360 and drive circuits 470.

Figure 2:
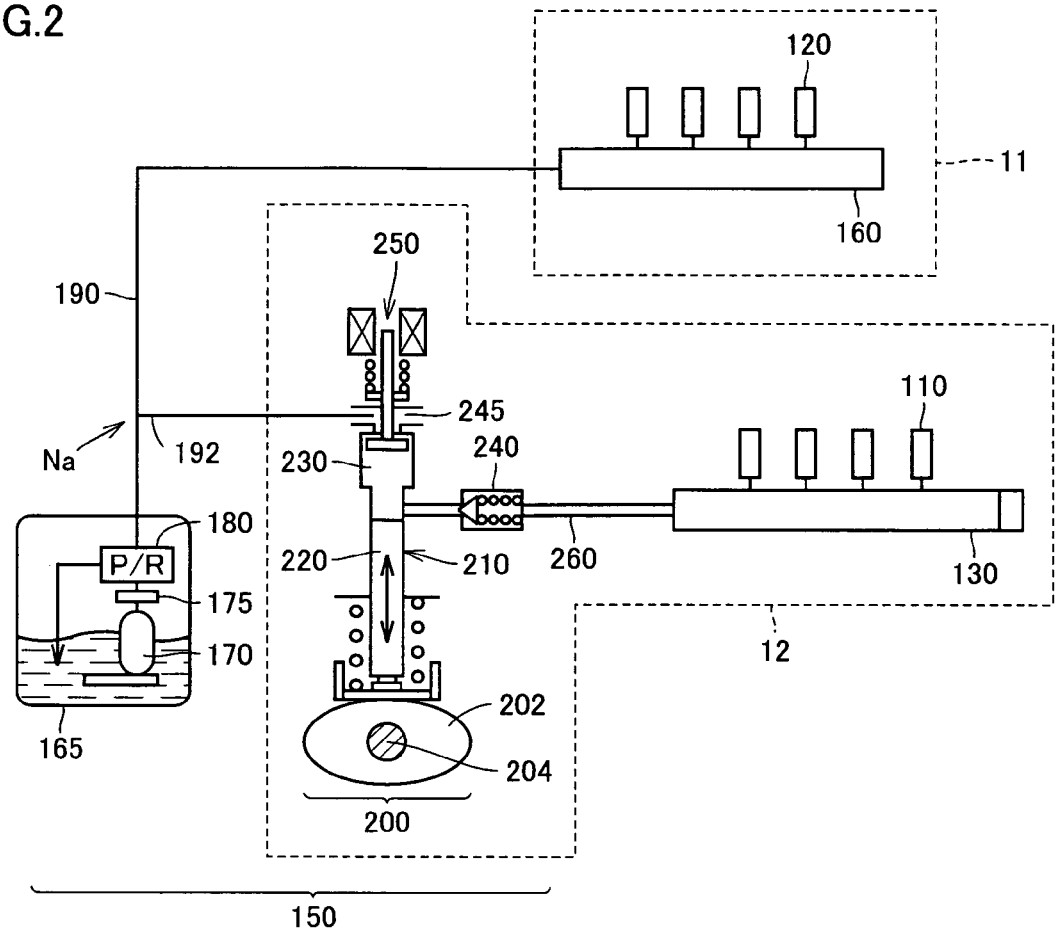
FIG. 2 is a block diagram illustrating a configuration of the fuel supply apparatus according to the embodiment of the present invention.

FIG. 2 illustrates a configuration of the fuel supply apparatus according to the embodiment of the present invention.

In FIG. 2, the portions other than in-cylinder injectors 110, high-pressure delivery pipe 130, intake manifold injectors 120 and low-pressure delivery pipe 160 correspond to the fuel supply portion 150 of FIG. 1.

Low-pressure fuel pump 170 draws fuel from a fuel tank 165, and discharges it at a prescribed pressure (low-pressure set value). The fuel discharged from low-pressure fuel pump 170 is delivered via a fuel filter 175 and a fuel pressure regulator 180 to a low-pressure fuel path. Low-pressure fuel pump 170 is of an electrically driven type, and its actuation timing and discharge quantity (flow rate) can be controlled by engine ECU 300.

The low-pressure fuel path is branched at a branch point Na into a fuel pipe 190 extending to low-pressure delivery pipe 160 and a fuel pipe 192 connected to high-pressure fuel pump 200. Fuel pressure regulator 180 is opened when the fuel pressure in the low-pressure system begins to increase, to form a route through which the fuel in the low-pressure fuel path in the vicinity of fuel pressure regulator 180, i.e., the fuel having just been pumped by low-pressure fuel pump 170, is returned to fuel tank 165. This can maintain the fuel pressure in the low-pressure fuel path at a prescribed level. Further, the fuel returned to fuel tank 165 is the one having just been pumped from fuel tank 165, which prevents a temperature increase in fuel tank 165.

High-pressure fuel pump 200 of an engine driven type is attached to a cylinder head (not shown). In high-pressure fuel pump 200, a plunger 220 within a pump cylinder 210 is driven in a reciprocating manner by rotation of a cam 202 for the pump that is provided at a camshaft 204 of an intake valve (not shown) or an exhaust valve (not shown) of engine 10. High-pressure fuel pump 200 further includes a high-pressure pump chamber 230 delimited by pump cylinder 210 and plunger 220, a gallery 245 connected to fuel pipe 192, and an electromagnetic spill valve 250 serving as a metering valve. Electromagnetic spill valve 250 is a valve that controls connection/disconnection between gallery 245 and high-pressure pump chamber 230.

The discharge side of high-pressure fuel pump 200 is connected via a high-pressure fuel path 260 to high-pressure delivery pipe 130 that delivers fuel to in-cylinder injectors 110. High-pressure fuel path 260 is provided with a check valve 240 that suppresses reverse flow of the fuel from fuel delivery pipe 130 toward high-pressure fuel pump 200. Further, low-pressure fuel pump 170 provided in fuel tank 165 is connected to the intake side of high-pressure fuel pump 200 via fuel pipe 192 and branch point Na.

Figure 3:
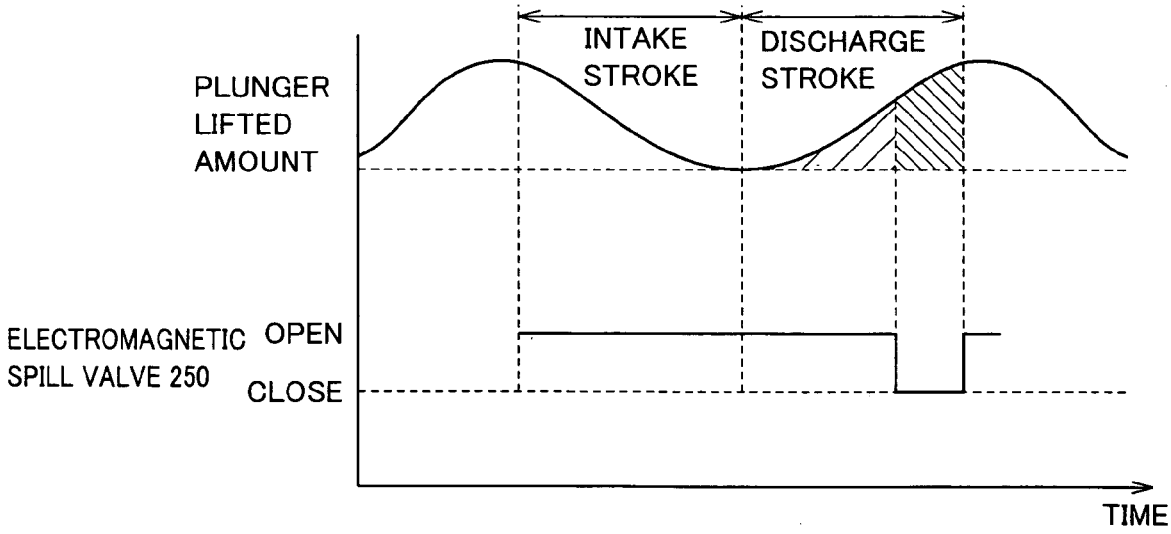
FIG. 3 is a conceptual diagram illustrating an operation of a high-pressure fuel pump shown in FIG. 2.

Referring to FIG. 3, in the intake stroke where the lifted amount of plunger 220 along with the rotation of cam 202 for the pump decreases, the volumetric capacity of high-pressure pump chamber 230 increases with the reciprocating motion of plunger 220. In the intake stroke, electromagnetic spill valve 250 is maintained in the open state.

Referring again to FIG. 2, during the valve-opening period of electromagnetic spill valve 250, gallery 245 is in communication with high-pressure pump chamber 230, so that the fuel is drawn from fuel pipe 192 via gallery 245 into high-pressure pump chamber 230 in the intake stroke.

Referring again to FIG. 3, in the discharge stroke where the lifted amount of plunger 220 by rotation of cam 202 for the pump increases, the volumetric capacity of high-pressure pump chamber 230 decreases with the reciprocating motion of plunger 220. In the discharge stroke, engine ECU 300 controls opening/closing of electromagnetic spill valve 250.

Referring again to FIG. 2, during the valve-opening period of electromagnetic spill valve 250 in the discharge stroke, gallery 245 is in communication with high-pressure pump chamber 230. Thus, the fuel drawn into high-pressure pump chamber 230 overflows to the side of fuel pipe 192 via gallery 245. That is, the fuel is discharged back toward fuel pipe 192 via gallery 245, rather than being delivered via high-pressure fuel path 260 to fuel delivery pipe 130.

Meanwhile, during the valve-closed period of electromagnetic spill valve 250, gallery 245 is not in communication with high-pressure pump chamber 230. Thus, the fuel pressurized in the discharge stroke is delivered via high-pressure fuel path 260 toward fuel delivery pipe 130, rather than reversely flowing into gallery 245.

Engine ECU 300 controls the opening/closing timing of electromagnetic spill valve 250 by referring to the fuel pressure detected by fuel pressure sensor 400 and the fuel injection quantity controlled by the ECU. As such, engine ECU 300 can control the quantity of the fuel pressurized at high-pressure fuel pump 200 and delivered to high-pressure delivery pipe 130, to thereby adjust the fuel pressure within high-pressure delivery pipe 130 to a required level.

As described above, in the fuel supply apparatus shown in FIG. 2, low-pressure fuel pump 170 commonly supplies fuel to a low-pressure fuel supply system 11, which is configured with intake manifold injectors 120 and low-pressure delivery pipe 160, and to a high-pressure fuel supply system 12, which is configured with in-cylinder injectors 110, high-pressure delivery pipe 130 and high-pressure fuel pump 200. This means that the fuel discharged from high-pressure fuel pump 200 back to fuel pipe 192 can cause pulsation in fuel pressure in low-pressure fuel supply system 11.

Figure 4:
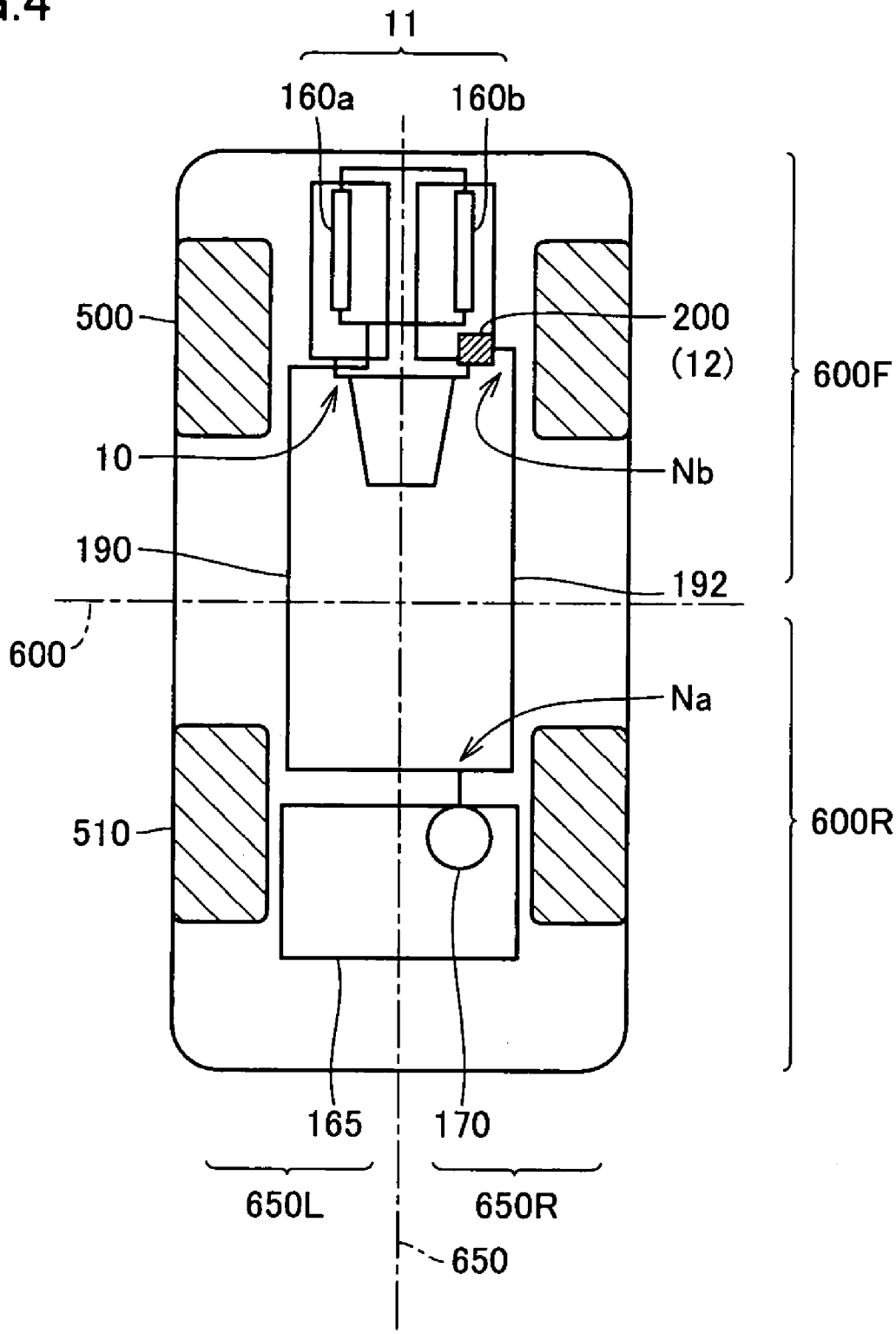
FIGS. 4 and 5 are block diagrams illustrating first and second examples, respectively, of the fuel pipe configuration in the fuel supply apparatus according to the embodiment of the present invention.

FIG. 4 shows a first example of a fuel pipe configuration in the fuel supply apparatus according to the embodiment of the present invention.

Referring to FIG. 4, in a vehicle incorporating the fuel supply apparatus according to the embodiment of the present invention, front wheels 500 and engine 10 are arranged in a front area 600F with respect to a center line 600 of the vehicle, and rear wheels 510 and fuel tank 165 are arranged in a rear area 600R. Low-pressure fuel pump 170 is arranged in fuel tank 165 in an integrated manner, as shown in FIG. 2 as well.

Low-pressure fuel supply system 11 including low-pressure delivery pipe 160 and high-pressure fuel supply system 12 including high-pressure fuel pump 200 are also arranged in front area 600F in association with engine 10.

In FIG. 4, a vehicle of the V-type engine arrangement is shown by way of example, in which low-pressure delivery pipes 160*a*, 160*b* are arranged for the respective banks. Hereinafter, low-pressure delivery pipes 160*a*, 160*b* are collectively referred to as low-pressure delivery pipe 160. As to high-pressure fuel supply system 12, the stages following high-pressure fuel pump 200, not shown in FIG. 4, are configured as shown in FIG. 2.

In the fuel supply apparatus according to the embodiment of the present invention, branch point Na between fuel pipe 190, which guides the fuel from fuel tank 165 (i.e., the fuel discharged from low-pressure fuel pump 170) to low-pressure fuel supply system 11, and fuel pipe 192, which guides the fuel from fuel tank 165 to high-pressure fuel supply system 12, is provided in the vicinity of fuel tank 165.

This configuration guarantees a long pipe length between low-pressure fuel supply system 11 and high-pressure fuel supply system 12, or more specifically, from high-pressure fuel pump 200 to low-pressure delivery pipe 160. As a result, it is possible to suppress variation in fuel pressure at low-pressure fuel supply system 11 due to the fuel discharged from high-pressure fuel pump 200 back to fuel pipe 192, and thus to stabilize the fuel pressure in respective fuel supply systems 11 and 12. It is noted that each of fuel pipes 190 and 192 may be arranged in a spiral manner or in a folded manner, to secure a longer pipe length.

Further, in the fuel supply apparatus according to the embodiment of the present invention, fuel pipe 190 for low-pressure fuel supply system 11 and fuel pipe 192 for high-pressure fuel supply system 12 are arranged in a left area 650L and a right area 650R, respectively, with respect to a center line 650 of the vehicle. Alternatively, fuel pipe 192 and fuel pipe 190 may be arranged in left area 650L and right area 650R, respectively, opposite to the arrangement shown in FIG. 4.

When one and the other of fuel pipes 190, 192 are arranged at left and right areas 650L, 650R, respectively, of the vehicle as described above, even if one of the fuel pipes, 190 or 192, is damaged due to collision at the side of the vehicle, for example, the remaining fuel pipe, 192 or 190, can continuously supply fuel to the corresponding fuel supply system, 12 or 11. This allows the driver to move the vehicle to safety with either in-cylinder injector 110 or intake manifold injector 120.

Figure 5:
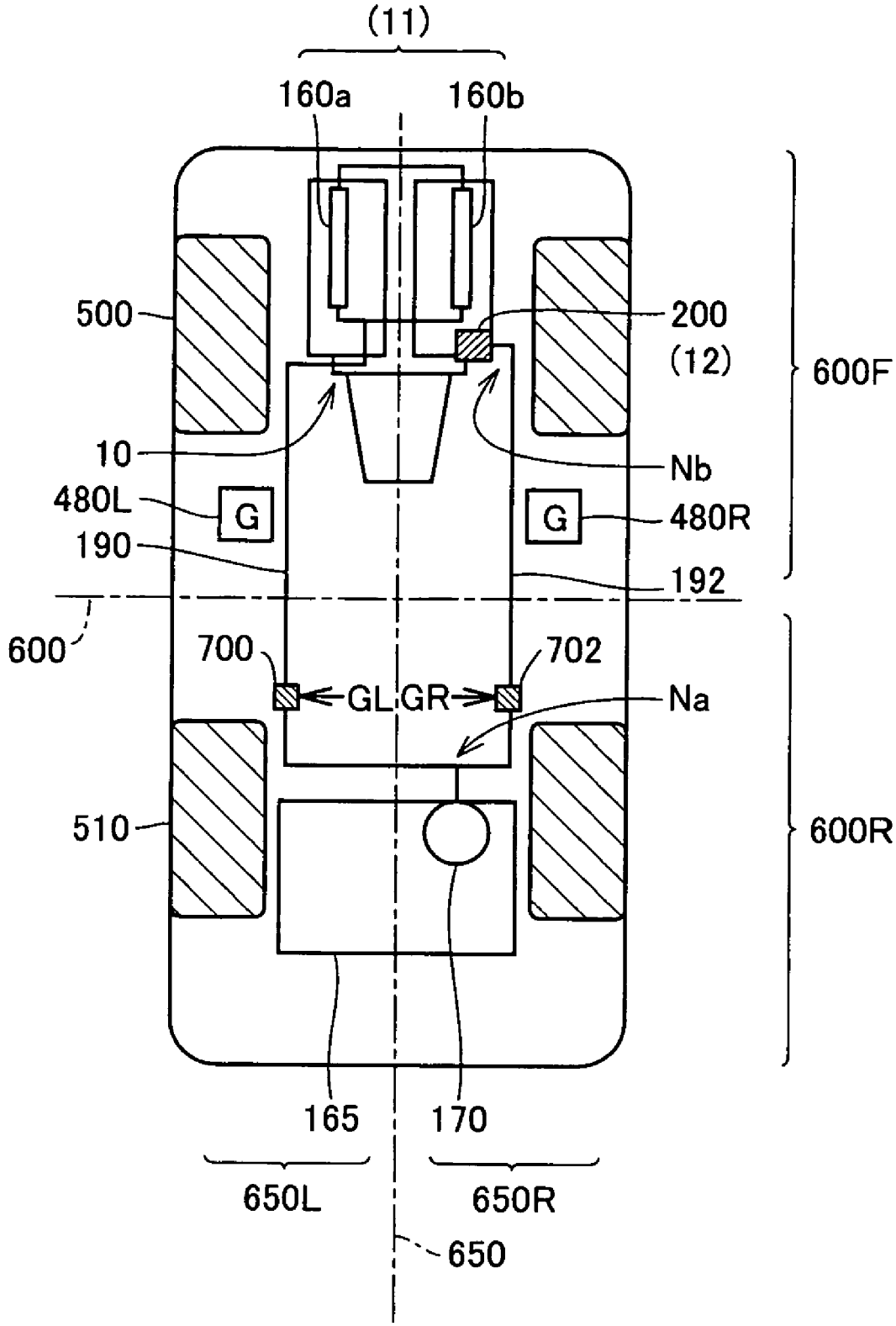

Further, fuel cutoff valves 700 and 702 may be arranged for fuel pipes 190 and 192, respectively, as shown in FIG. 5. Fuel cutoff valve 700 is actuated in response to a control signal GL from engine ECU 300, to cut off the fuel supply from fuel tank 165 to low-pressure fuel supply system 11. Similarly, fuel cutoff valve 702 is actuated in response to a control signal GR from engine ECU 300, to cut off the fuel supply from fuel tank 165 to high-pressure fuel supply system 12.

Control signal GL is output when the acceleration detected by acceleration sensor 480L arranged in left area 650L of the vehicle attains a prescribed level or more. Similarly, control signal GR is output when the acceleration detected by acceleration sensor 480R arranged in right area 650R of the vehicle becomes equal to or greater than a prescribed threshold value. This threshold value is set such that collision at the side of the vehicle leading to breakage of fuel pipe 190 or 192 can be detected.

With the configuration shown in FIG. 5, when there occurs a collision at the side of the vehicle, fuel cutoff valve 700 or 702 on the damaged side can be actuated in response to the acceleration detected by acceleration sensor 480L or 480R at the relevant side exceeding the threshold value. As such, it is possible to automatically detect occurrence of collision at the side of the vehicle and to suppress occurrence of fuel leakage due to damage to fuel pipe 190, 192 and/or low-pressure fuel supply system 11 or high-pressure fuel supply system 12 on the collided side. Although the configuration where fuel cutoff valves 700, 702 are arranged for fuel pipes 190, 192 has been shown by way of example in FIG. 5, a configuration having a fuel cutoff valve arranged for only one fuel pipe is also possible.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fuel supply apparatus for a vehicle, comprising:

a fuel tank for storing fuel;

a first fuel supply system including a first fuel injection mechanism for injecting fuel into an internal combustion engine;

a second fuel pipe supply system including a second fuel injection mechanism different from said first fuel injection mechanism for injecting fuel into said internal combustion engine;

a first fuel pipe for guiding said fuel from said fuel tank to said first fuel supply system; and a second fuel pipe for guiding said fuel from said fuel tank to said second fuel supply system; wherein a branch point between said first and second fuel pipes is arranged such that a fuel pipe length between said branch point and said fuel tank is shorter than a fuel pipe length between said branch point and each of said first and second fuel supply systems to ensure pressure variation suppression, said first fuel supply system includes a high-pressure fuel pump for pressurizing the fuel guided by said first fuel pipe and discharging resultant fuel, and is configured to control a pressure of the fuel injected from said first fuel injection mechanism to a prescribed pressure, and said second fuel supply system is configured to set a pressure of the fuel injected from said second fuel injection mechanism to a pressure lower than said prescribed pressure.

2. The fuel supply apparatus for a vehicle according to claim 1, further comprising a fuel cutoff valve in at least one of said first and second fuel pipes, arranged between a branch point of said first and second fuel pipes and said first or second fuel supply system, wherein said fuel cutoff valve is arranged in the vicinity of said branch point.

3. The fuel supply apparatus for a vehicle according to claim 1, wherein said fuel tank is arranged in a rear area with respect to the center of said vehicle;

said internal combustion engine is arranged in a front area with respect to the center of said vehicle; and said first and second fuel pipes being branched in the vicinity of said fuel tank.

4. The fuel supply apparatus for a vehicle according to claim 1 wherein said fuel tank is arranged in a rear area with respect to the center of said vehicle;

said internal combustion engine is arranged in a front area with respect to the center of said vehicle; and said first and second fuel pipes are branched in said rear area of said vehicle.

5. The fuel supply apparatus for a vehicle according to claim 1, wherein one and the other of said first and second fuel pipes are arranged in a right area and a left area, respectively, with respect to the center of said vehicle.

6. The fuel supply apparatus for a vehicle according to claim 2, further comprising an acceleration sensor provided for at least one of said first and second fuel pipes corresponding to said fuel cutoff valve, wherein said fuel cutoff valve is actuated in accordance with a detected value of the corresponding acceleration sensor, to cut off said fuel.

* * * * *